US009963914B2

(12) United States Patent
Luizzi et al.

(10) Patent No.: US 9,963,914 B2
(45) Date of Patent: May 8, 2018

(54) TEMPORARY DOOR HARDWARE SYSTEM AND DOOR

(71) Applicants: Peter Luizzi, Albany, NY (US); Bryant Luizzi, Albany, NY (US)

(72) Inventors: Peter Luizzi, Albany, NY (US); Bryant Luizzi, Albany, NY (US)

( * ) Notice: Subject to any disclaimer, the term of this patent is extended or adjusted under 35 U.S.C. 154(b) by 20 days.

(21) Appl. No.: 14/251,089

(22) Filed: Apr. 11, 2014

(65) Prior Publication Data

US 2014/0306461 A1 Oct. 16, 2014

Related U.S. Application Data

(60) Provisional application No. 61/810,953, filed on Apr. 11, 2013.

(51) Int. Cl.
*E05B 3/00* (2006.01)
*E05B 1/00* (2006.01)
(Continued)

(52) U.S. Cl.
CPC ..... *E05B 63/0034* (2013.01); *E05B 1/0015* (2013.01); *E05C 19/028* (2013.01); *Y10T 292/0969* (2015.04)

(58) Field of Classification Search
CPC ..... E05C 19/02; E05C 19/022; E05C 19/028; E05C 19/06; E05C 19/063; E05C 1/12; E05C 1/004; E05C 1/002; E05C 1/02; E05C 1/04; E05C 1/06; E05C 1/08; E05C 1/085; E05C 1/10; E05B 63/0043; E05B 1/0015; E05B 63/0034
USPC ..... 206/321, 325; 49/380, 501, 503, 504; 292/163, 137, 164, 170, 175, 138, 292/145–147, 150, 300, 302, 288, 347,
(Continued)

(56) References Cited

U.S. PATENT DOCUMENTS 2,581,606 A * 1/1952 Seaman ..... E05B 15/025 292/74
3,057,649 A * 10/1962 Check ..... E05B 63/22 292/150
(Continued)

FOREIGN PATENT DOCUMENTS

| | | | |
|---|---|---|---|
| GB | 2357797 | A | 7/2001 |
| WO | 2007097630 | A1 | 8/2007 |
| WO | 2008072974 | A1 | 6/2008 |

*Primary Examiner* — Alyson M Merlino
(74) *Attorney, Agent, or Firm* — Schmeiser, Olsen & Watts, LLP

(57) ABSTRACT

A temporary door hardware system comprising a first side component configured to be exposed from a side of a door when the temporary door hardware system is installed in the door, a second side component attachable to the first side component and configured to be exposed from another side of the door when the temporary door hardware system is installed in the door, a latch assembly securable between the first and second side component when the components are installed in the door, wherein the latch assembly is dimensioned for integration with an opening in an door frame, wherein the latch assembly includes a spring bias configured to extend the latch assembly into the opening and retract the latch assembly from the opening, wherein the spring bias allows the latch assembly to retract from the opening when a threshold force is exerted on the door is provided.

21 Claims, 19 Drawing Sheets

(51) Int. Cl.
*E05B 63/00* (2006.01)
*E05C 19/02* (2006.01)

(58) Field of Classification Search
USPC ... 292/348, 349, 353, 355, DIG. 2, DIG. 27, 292/DIG. 38, DIG. 63, DIG. 65, DIG. 73, 292/1, 357
See application file for complete search history.

(56) References Cited

U.S. PATENT DOCUMENTS 3,125,366 A * 3/1964 Cetrone et al. ..... E05C 1/16 292/169.14
3,385,622 A * 5/1968 Winger ..... E05C 1/14 292/170
3,508,777 A * 4/1970 McBurnie ..... E05B 63/248 292/254
3,853,341 A * 12/1974 MacDonald ..... E05B 53/003 292/171
3,858,918 A * 1/1975 McBurnie ..... E05C 1/163 292/169.15
4,109,948 A * 8/1978 Potter ..... E05C 1/163 292/169.15
4,169,618 A * 10/1979 Potter ..... E05C 1/163 292/169.15
5,190,327 A * 3/1993 Lin ..... E05B 3/06 292/348
5,192,097 A 3/1993 Su
6,135,512 A 10/2000 Galvin
6,312,026 B1 * 11/2001 Workman ..... E05B 1/0053 292/252
6,874,827 B1 4/2005 Dodson
7,882,594 B2 2/2011 Ramsauer
8,052,178 B2 11/2011 MacDonald et al.

* cited by examiner

TEMPORARY DOOR HARDWARE SYSTEM AND DOOR

RELATED MATTERS

This Non-Provisional application claims priority to U.S. Provisional Application Ser. No. 61/810,953, filed Apr. 11, 2013, the disclosure of which is herein incorporated by reference to the extent that it is consistent with the present application.

FIELD OF THE DISCLOSURE

The subject matter disclosed herein relates generally to door hardware systems such as handles, knobs, locks, stops, and the like. More particularly, the subject matter relates to a door hardware system that may be temporarily attached to a door and removed prior to installation of a permanent hardware system.

BACKGROUND OF THE DISCLOSURE

In the construction industry, temporary door hardware such as locks, stops or handles are typically placed on the doors of buildings that are undergoing construction. This temporary door hardware is configured to prevent the door from opening and closing in the wind, causing potential damage to the door and to the interior of the building being constructed. Further, in some instances, temporary door hardware may prevent unwanted people from entering into the building being constructed at night. In large construction buildings, such as multi-floor apartment buildings or commercial office buildings, there are hundreds or even thousands of doors that require temporary hardware. This hardware is often expensive and made of metal. Due to the expense, contractors must generally find a place to store the hardware until the next construction project.

Thus, it would be well received in the art to have less costly door hardware that is specifically configured to be temporary and/or disposable after use.

BRIEF DESCRIPTION

According to one embodiment, a temporary door hardware system comprises: a first side component configured to be exposed from a first side of a door when the temporary door hardware system is installed in the door; a second side component attachable to the first side component and configured to be exposed from a second side of the door when the temporary door hardware system is installed in the door; a latch assembly securable between the first and second side component when the first and second side component are installed in the door, wherein the latch assembly is dimensioned for integration with an opening in an door frame, wherein the latch assembly includes a spring bias configured to extend the latch assembly into the opening and retract the latch assembly from the opening, wherein the spring bias allows the latch assembly to retract from the opening when a threshold force is exerted on the door.

According to another embodiment, a temporary door hardware system comprises: a first side component configured to be accessible from a first side of a door when the temporary door hardware system is installed in the door; a second side component attachable to the first side component and configured to be accessible from a second side of the door when the temporary door hardware system is installed in the door; wherein the first and second side components include a mechanism for attaching the first and second side components together such that unattachment of the first and second sides requires permanent destruction of the mechanism.

According to another embodiment, a door comprises: a first side having a first surface a second side having a second surface; a door handle comprising: a first side component exposed from the first side of the door; a second side component attached to the first side component and exposed from a second side of the door; a latch assembly securable between the first and second side component, wherein the latch assembly is dimensioned for integration with an opening in an door frame, wherein the latch assembly includes a spring bias configured to extend the latch assembly into the opening and retract the latch assembly from the opening, wherein the spring bias allows the latch assembly to retract from the opening when a threshold force is exerted on the door.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

A detailed description of the hereinafter described embodiments of the disclosed apparatus and method are presented herein by way of exemplification and not limitation with reference to the Figures.

Figure 1:
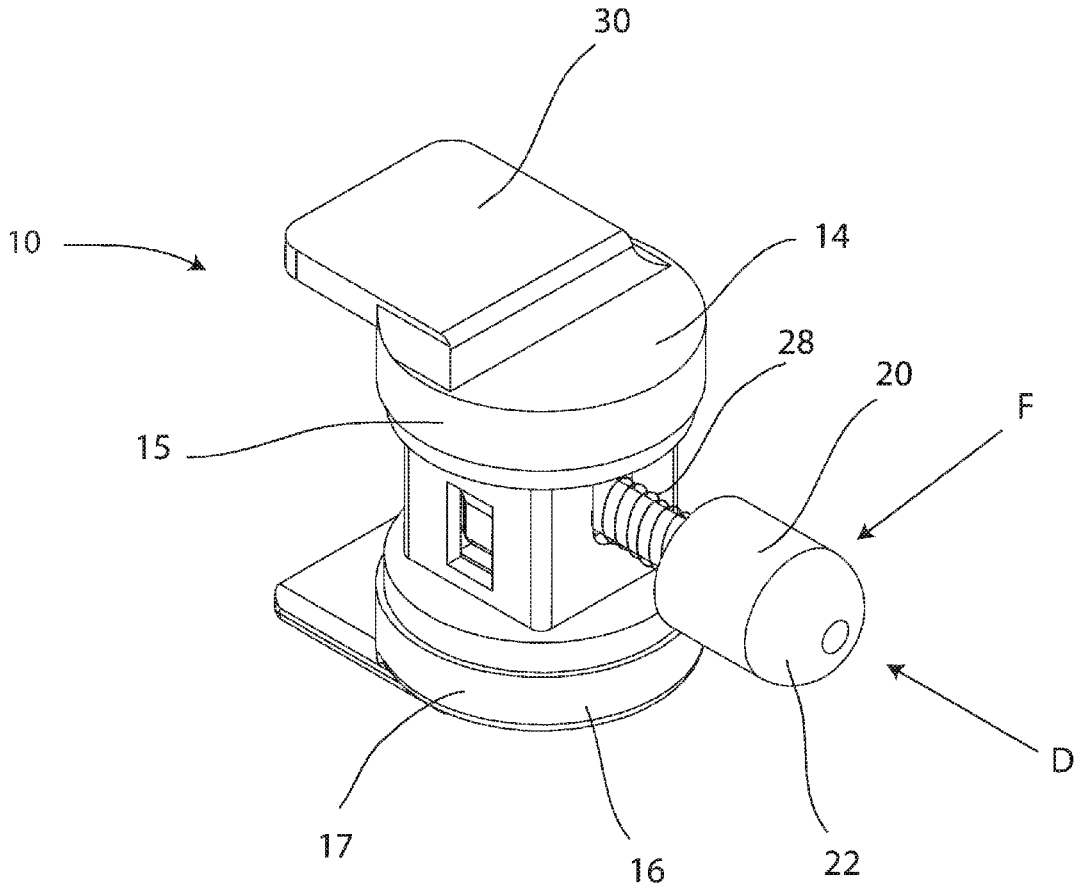
FIG. 1 depicts a perspective view of a temporary door hardware system in accordance with one embodiment.
Figure 2:
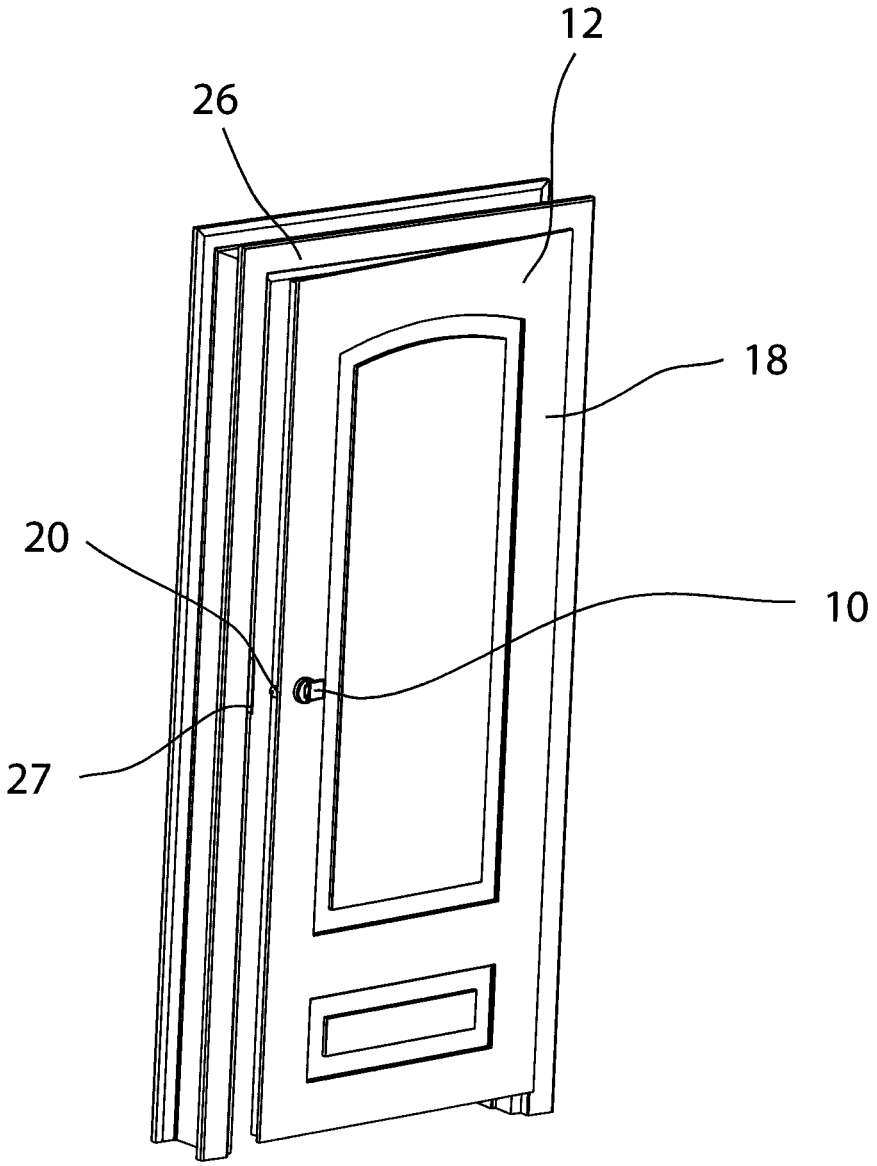
FIG. 2 depicts a perspective view of the temporary door hardware system of FIG. 1 attached to a door in accordance with one embodiment.
Figure 3:
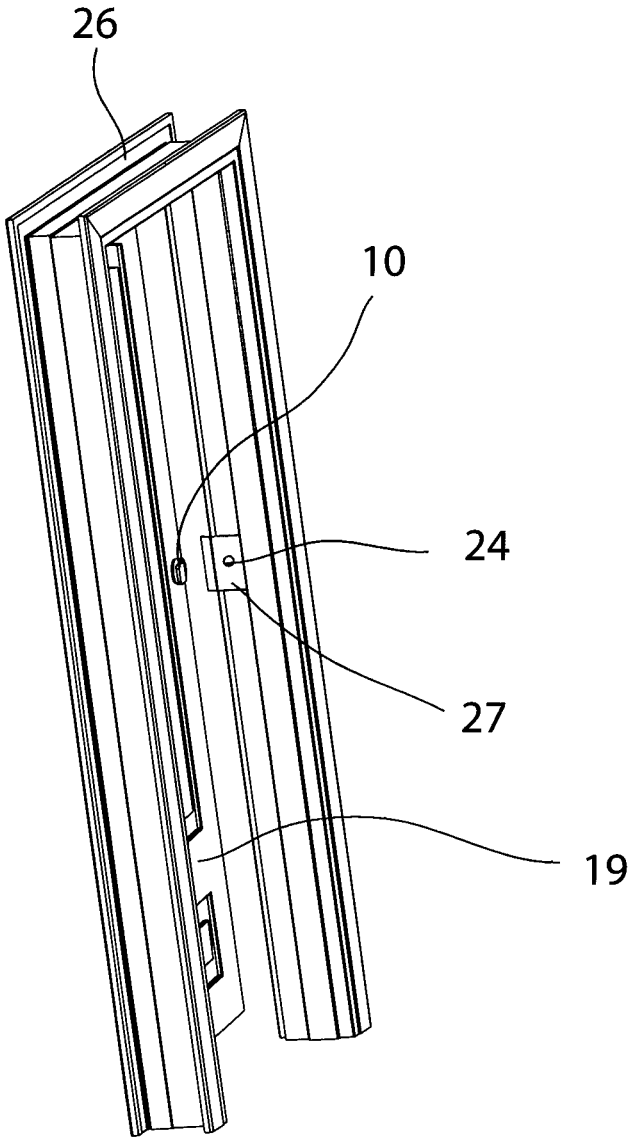
FIG. 3 depicts a perspective view of the temporary door hardware system of FIGS. 1 and 2 attached to a door in accordance with one embodiment.

Referring to FIGS. 1-3, a temporary door hardware system 10 is shown. As shown in FIGS. 2 and 3, the temporary door hardware system 10 is attached to a door 12. The temporary door hardware system 10 is shown having a first side component 14 and a second side component 16. The first side component 14 may be exposed from a first side 18, face or surface of the door 12 when the temporary door hardware system 10 is installed in the door 12. Likewise, the second side component 16 may be exposed from a second side, face or surface 19 of the door 12 when the temporary door hardware system 10 is installed in the door 12. It should be understood that FIG. 2 shows one side face or surface 18 of the door 12 with the temporary door hardware system 10 and that a similar side, face or surface 19 may be found on the opposite side of the door 12, as shown in FIG. 3. The first side component 14 may further include a main body 15 which may be circumferential or cylindrical in shape. Likewise, the second side component 16 may include a main body 17 which may also be circumferential or cylindrical in shape. The main bodies 15, 17 may be dimensioned with similar dimensions and may each be configured to fit into a circular opening found in the standard doors which are configured to receive standard door hardware, knobs, handles and the like. These main bodies 16, 17 may each include a ridge 21 for accommodation the dimensions of the standard door opening.

The temporary door hardware system 10 may further include a latch assembly 20. The latch assembly 20 may also be referred to as a plunger device, fastener or the like, and may be configured to retain the door 12 in a closed state with respect to an outer door frame 26. The latch assembly 20 may be securable between the first and second side components 14, 16 when the first and second side components 14, 16 are installed in the door 12 as shown in FIGS. 2 and 3. The latch assembly 20 may include a first end 22 which is dimensioned for integration with an opening 24 in the door frame 26. The opening 24 may be directly integrated into the door frame 26 or may be accommodated with an additional strike plate component 27 which may be included in the temporary door hardware system 10 and installed into the door frame 26. The latch assembly 20 may include a spring 28 or other form of spring biasing element configured to extend the first end 22 of the latch assembly 20 into the opening 24 and retract the first end 22 of the latch assembly 20 from the opening 24. The spring 28 may allow the first end 22 of the latch assembly 20 to retract from the opening 24 when a threshold force is exerted on the door 12. In other words, the spring constant of the spring 28 may be particularly fashioned to require specific threshold force to retract the latch assembly 20. The threshold force exerted on the door 12 may also be considered a force that is exerted on the latch assembly 20 in a direction that is perpendicular to the direction of extension and retraction of the latch assembly 20. This is because the latch assembly 20, of course, is a component of the temporary door hardware system 10, and thereby a force exerted on the door 12 will result in the same or similar force on the latch assembly 20. Thus, the latch assembly 20 may be configured to extend and retract in a direction which is parallel to the door 12, while the force may be applied perpendicular to both the door 12 and the direction of extension and retraction of the latch assembly 20.

In order to achieve a low-cost and temporary door hardware system 10, it should be understood that the major components of the temporary door hardware system 10 may be made of non-metallic low cost components. For example, each of the first side component 14, the second side component 16, and the latch assembly 20 may be made from plastic, wood, rubber, a composite or the like. Each of these components 14, 16, 20 may, for example, not be made of metal in direct contrast to permanent hardware fixtures. As such, in one embodiment, the temporary door hardware system 10 may not be configured to prevent unwanted entry through the door 12 or prevent the door from being opened by unwanted individuals. This is because the temporary door hardware system 10 may be utilized on construction sites rather than in finished buildings, where trespass and break-ins are less of a problem. In other embodiments, a version of the temporary door hardware system 10 may include lock system (not shown) as for the deterrence of trespassers.

The first and second side components 14, 16 of the temporary door hardware system 10 may minimally extend from the surfaces 18, 19 of the door 12. In other words, the first and second side components 14, 16 may not include a handle at all, but may simply include flat surfaces 30, 32 which are adjacent to the surfaces 18, 19 of the door 12. In one embodiment, no component of the first and second side components 14, 16, including these flat surfaces 30, 32, when installed in the door 12, may extend more than 0.5 inches from the surfaces 18, 19, respectively, of the door 12. In other embodiments, the first and second side components 14, 16 may extend less than 0.25 inches from the door surfaces 18, 19 when installed in the door 12. In still other embodiments, the first and second side components 14, 16 may extend less than one inch from the door surfaces 18, 19 when installed in the door 12. These flat surfaces 30, 32 may extend from the main bodies 15, 17, respectively. The flat surfaces 18, 19, may extend beyond the bounds of the outer dimensions of the main bodies 15, 17 on one side of the main body 15, 17. The flat surfaces 18, 19 may be configured to stop the temporary door hardware system 10 from being insertable into the opening of the door 12 and removed therefrom.

The fact that the temporary door hardware system 10 may not include traditional handles, knobs or the like may reduce the overall width of the temporary door hardware system 10. This reduced width may allow the temporary door hardware system 10 to be installed on the door 12 during the manufacturing stages of the door 12 without increasing the thickness dimensions of the door 12 unnecessarily. This may reduce transportation and storage cost and may increase the desirability of the temporary door hardware system 10 to be integrated into the door 12 at the manufacturing stage. While the first and second side components 14, 16 are shown including surfaces 30, 32 that are directly adjacent to the surface of the door, this may be difficult for people to grip to pull the door open. Thus, the latch assembly 20 may be configured to retract from the opening 24 when a relatively low amount of threshold force is applied by a person on the door 12. For example, the threshold force may be large enough to prevent the latch assembly 20 from being removed from the opening 24 when wind forces are exerted on the door. However, the threshold force may be small enough to allow the plunger to be removed from the opening when a person exerts a direct pushing force on the door, or pulling force on one of the surfaces 30, 32.

In one embodiment, the first and second side components 14, 16 may include a storing state and an in-use state. In the storing state, the surfaces 30, 32 of the first and second side components 14, 16 may be located immediately adjacent to the surfaces 18, 19 of the door 12, as shown in FIGS. 2-3. However, the first and second side components 14, 16 may include one or more locking hinges or the like (not shown) that may enable the surfaces 30, 32 to be switched to the in-use state. In the in-use state, the surfaces 30, 32 may be unsnapped, unlocked, unhinged, or the like in order to switch the first and second side components 14, 16 from the storing state, where the surfaces 30, 32 immediately adjacent to the surfaces 18, 19 of the door 12, to the in-use state, where the surfaces 30, 32 are pulled from the surfaces 18, 19 of the door 12 for ease of gripping. The surfaces 30, 32 may thus be locked, snapped or otherwise retained into place farther from the surfaces 18, 19 of the door 12 during the in-use state. The surfaces 30, 32 may be configured to switch between the in-use state and the storing state. Other handles that may be switched between a storing state and an in-use state are contemplated. For example, the temporary door hardware system 10 may include a separate handle portion (not shown) attachable to either the main body 15, 17 or the surface 30, 32. The separate handle portion may be configured to rest immediately adjacent to the surface 18, 19 of the door 12 when in a storing and transportation state, and may be extendable to provide a handle after installation of the door 12.

Furthermore, the surfaces 30, 32 may be replaced by a standard dimensioned handle or knob (not shown) which may allow for a person to grip and pull on the temporary door hardware system 10 and open the door 12. In this case, the handle or knob may not be configured to interact with the latch assembly 20. In other words, if the temporary door hardware system 10 includes a handle or knob, the handle or knob may not be configured to turn, and may only be functional to the extent that the handle or knob provides a component to grip and pull the door 12.

Figure 4:
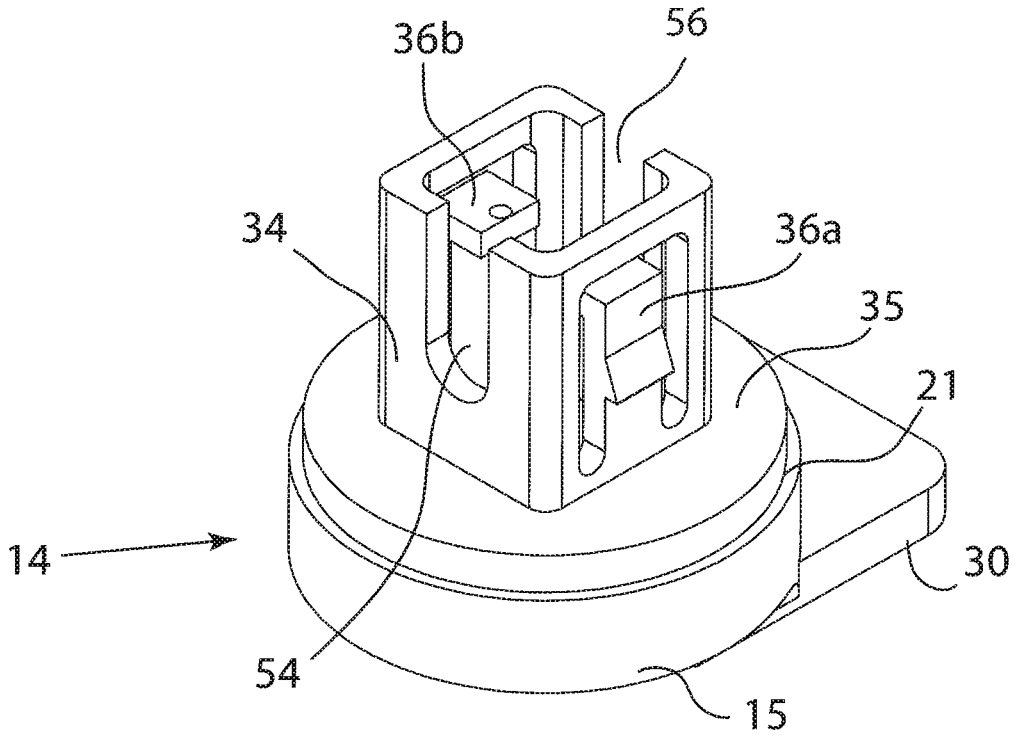
FIG. 4 depicts a first perspective view of a first side component of the temporary door hardware system shown in FIGS. 1-3 in accordance with one embodiment.
Figure 5:
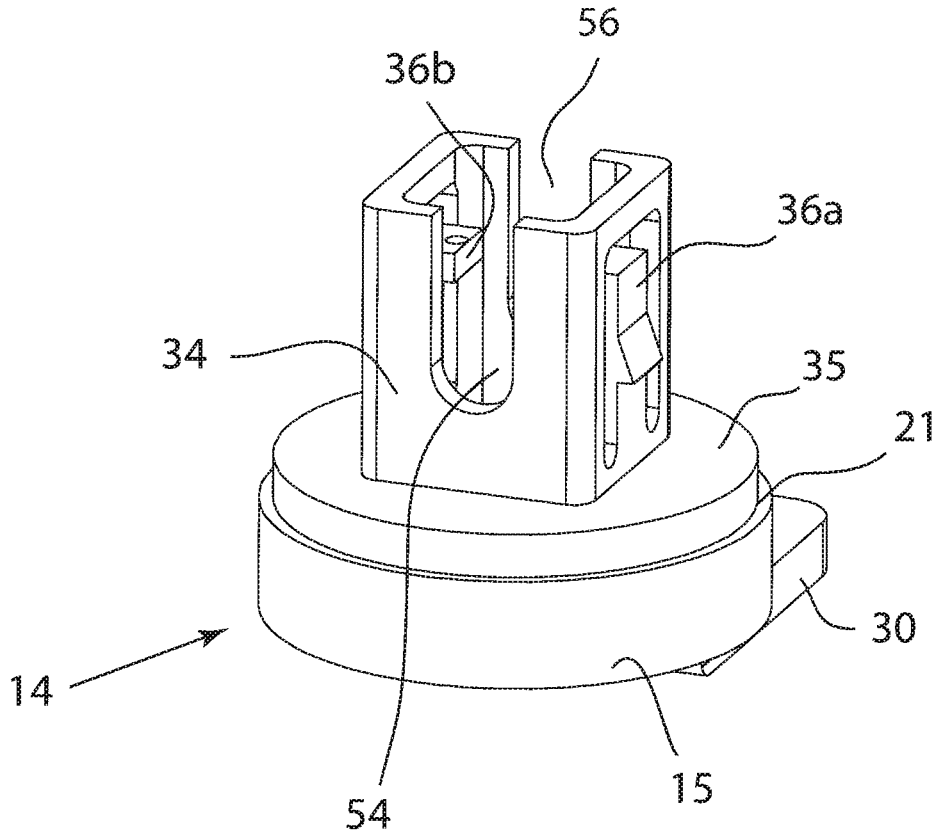
FIG. 5 depicts a second perspective view of the first side component shown in FIG. 4 in accordance with one embodiment.
Figure 6:
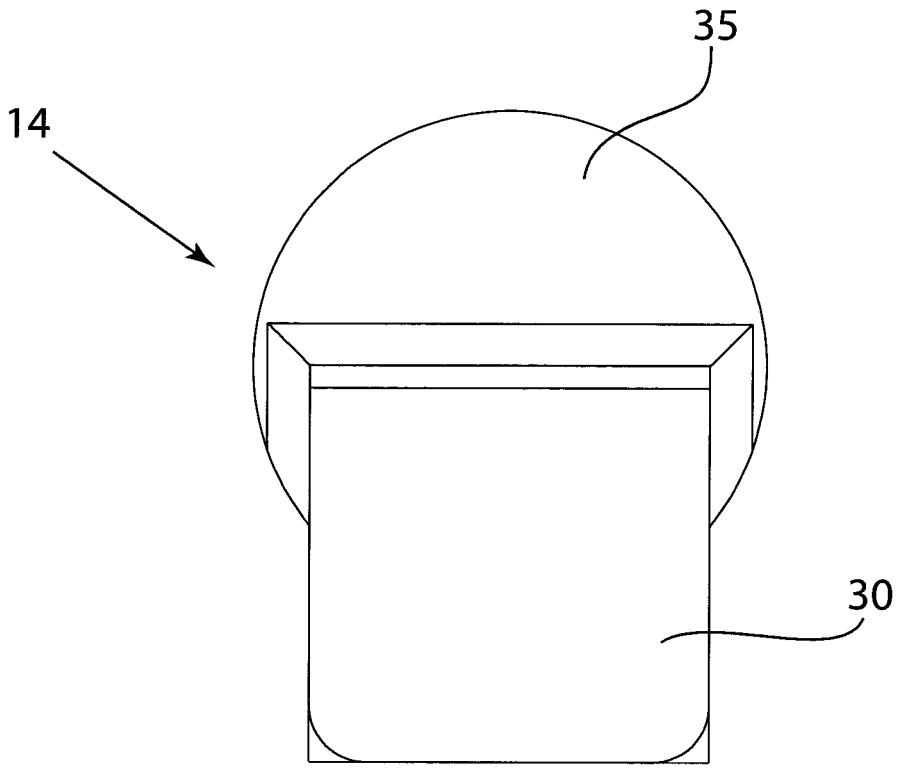
FIG. 6 depicts a top view of the first side component shown in FIGS. 4-5 in accordance with one embodiment.
Figure 7:
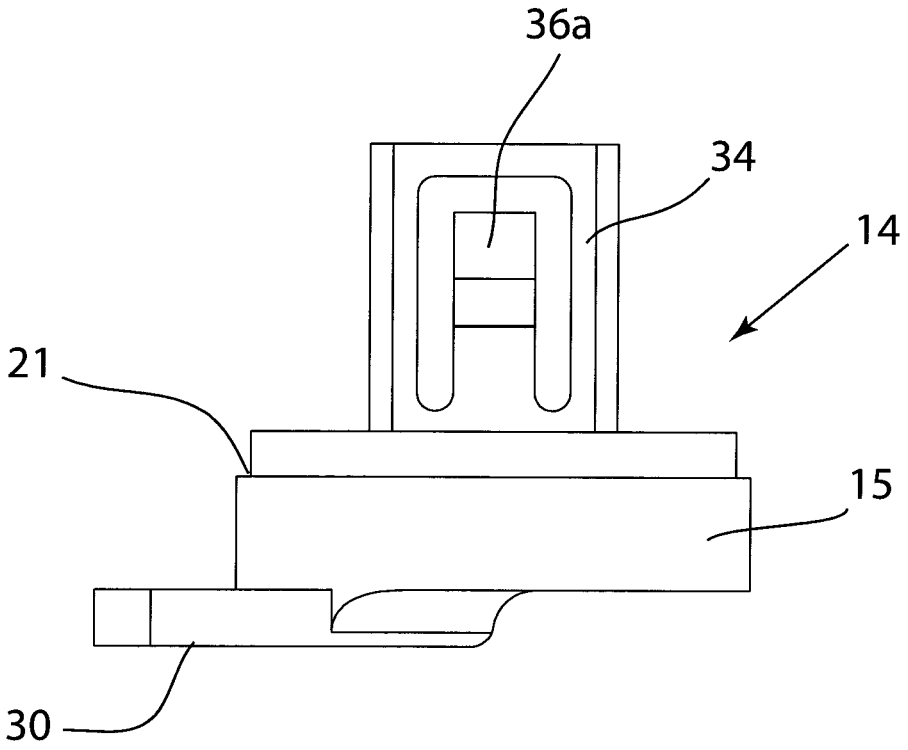
FIG. 7 depicts a left side view of the first side component shown in FIGS. 4-6 in accordance with one embodiment.
Figure 8:
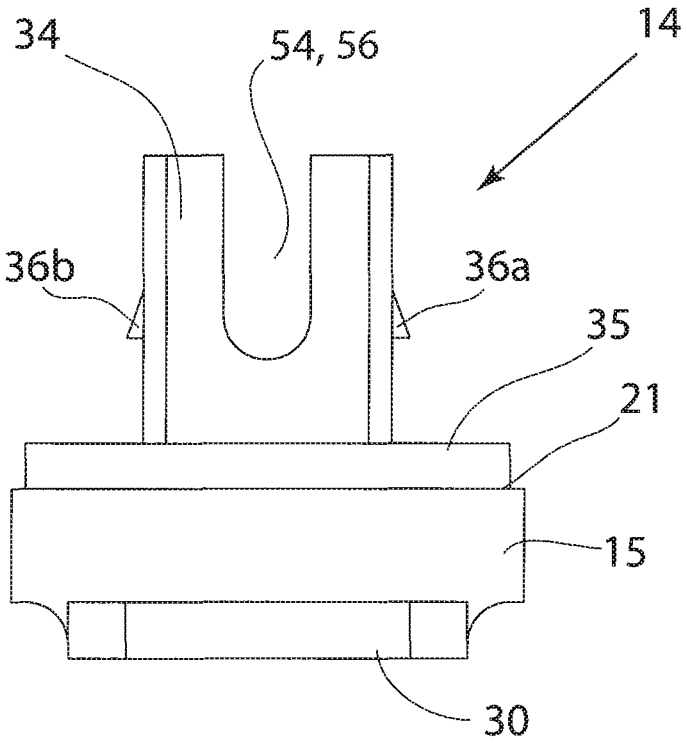
FIG. 8 depicts a front side view of the first side component shown in FIGS. 4-7 in accordance with one embodiment.
Figure 9:
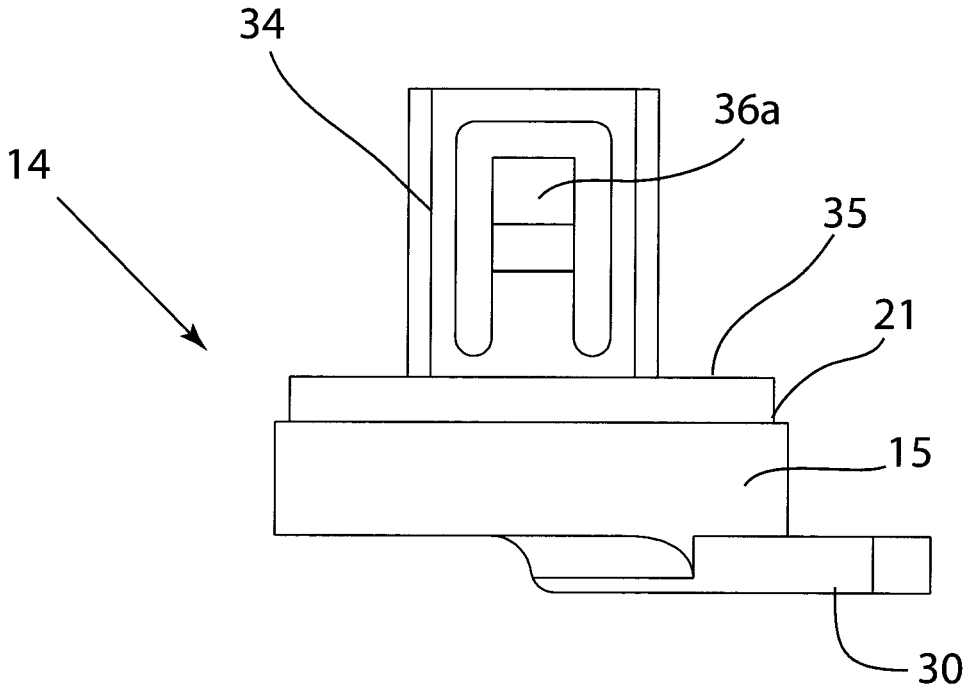
FIG. 9 depicts a right side view of the first side component shown in FIGS. 4-8 in accordance with one embodiment.
Figure 10:
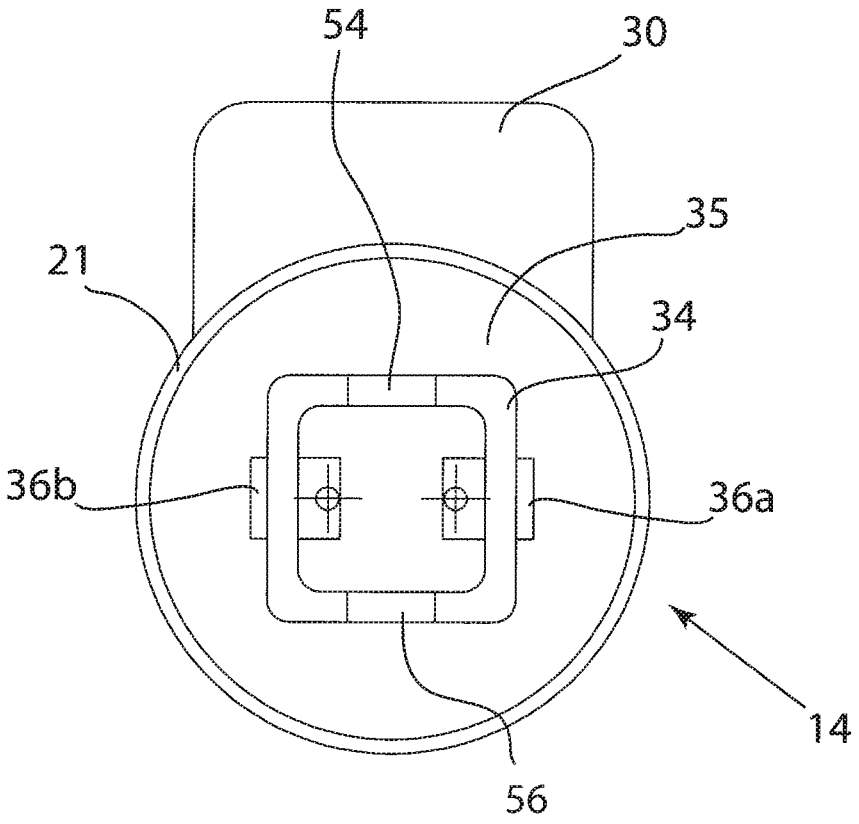
FIG. 10 depicts a bottom view of the first side component shown in FIGS. 4-9 in accordance with one embodiment.
Figure 11:
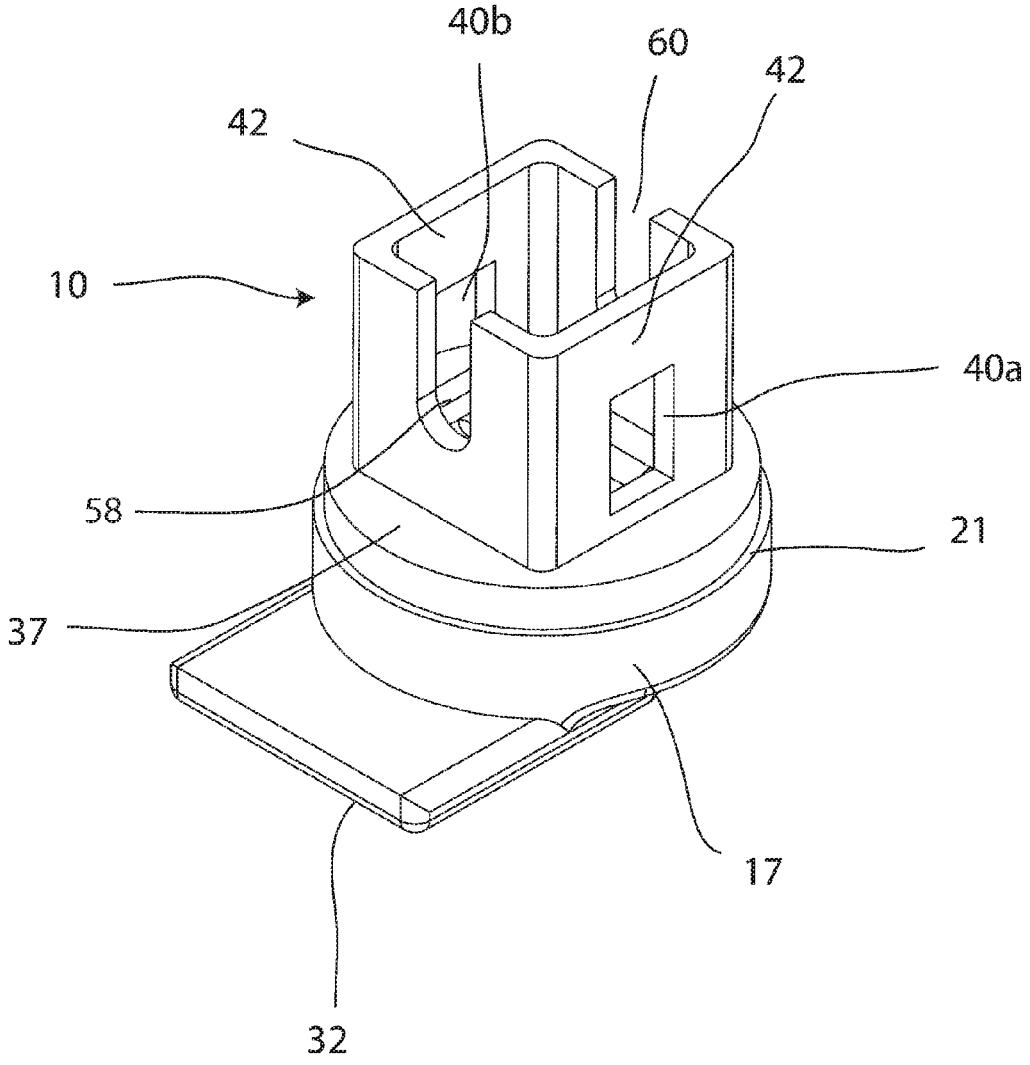
FIG. 11 depicts a first perspective view of a second side component of the temporary door hardware system shown in FIGS. 1-3 in accordance with one embodiment.
Figure 12:
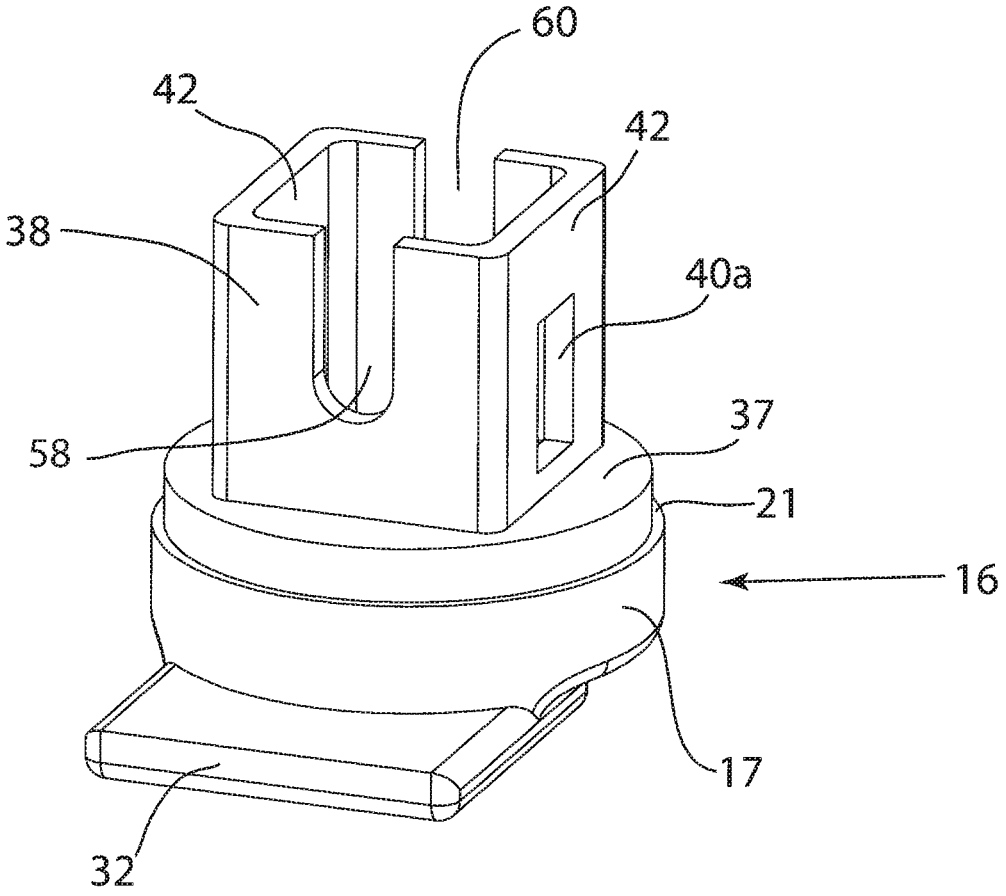
FIG. 12 depicts a second perspective view of the second side component shown in FIG. 11 in accordance with one embodiment.
Figure 13:
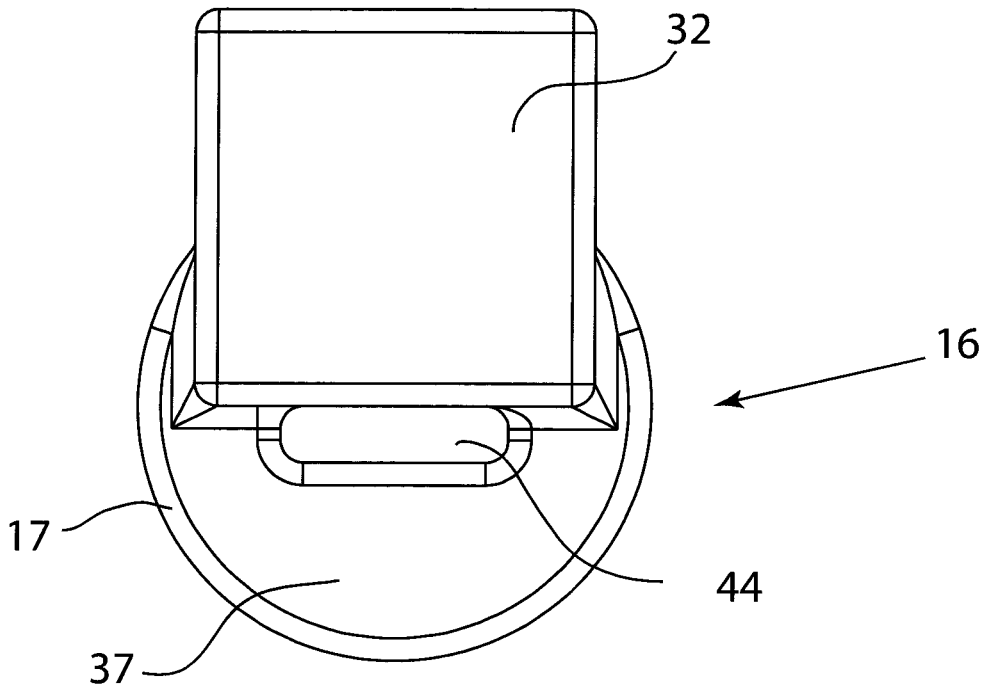
FIG. 13 depicts a top view of the second side component shown in FIGS. 11-12 in accordance with one embodiment.
Figure 14:
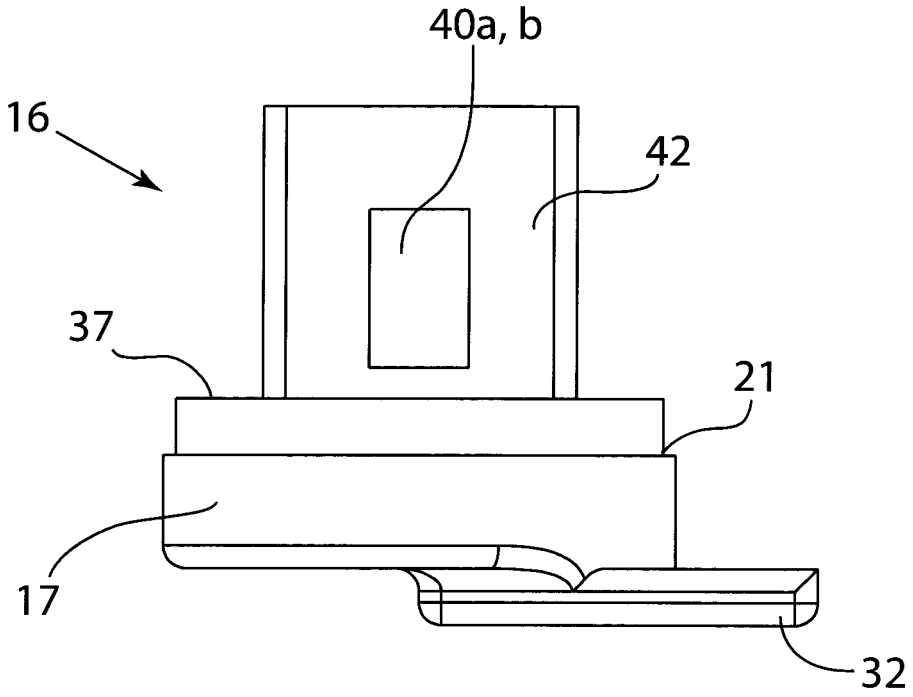
FIG. 14 depicts a left side view of the second side component shown in FIGS. 11-13 in accordance with one embodiment.
Figure 15:
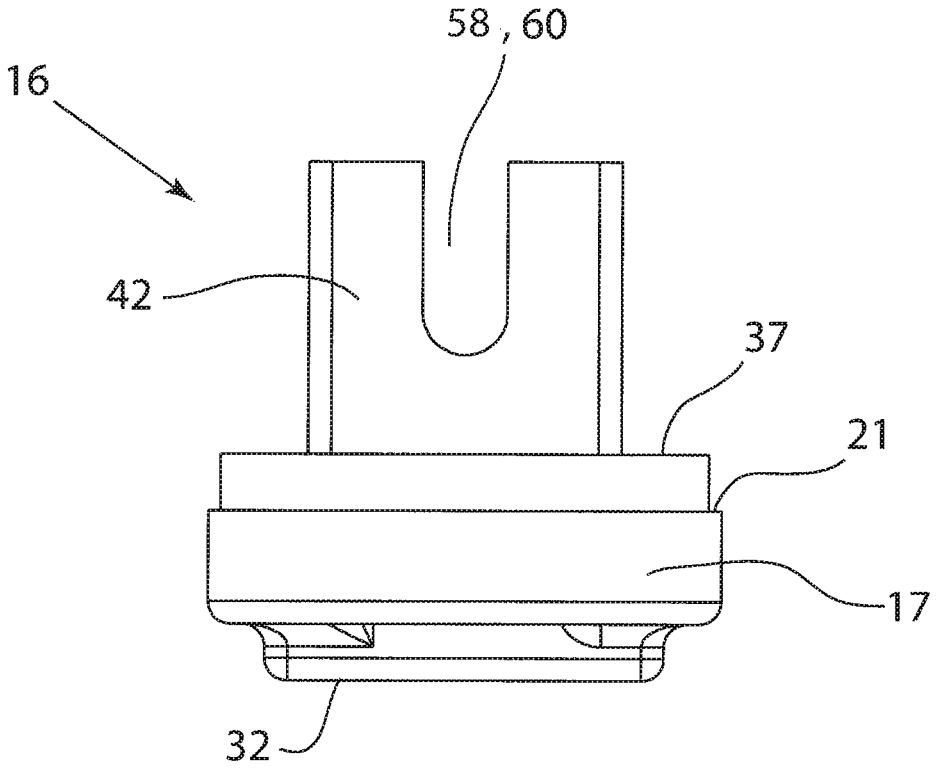
FIG. 15 depicts a front side view of the second side component shown in FIGS. 11-14 in accordance with one embodiment.
Figure 16:
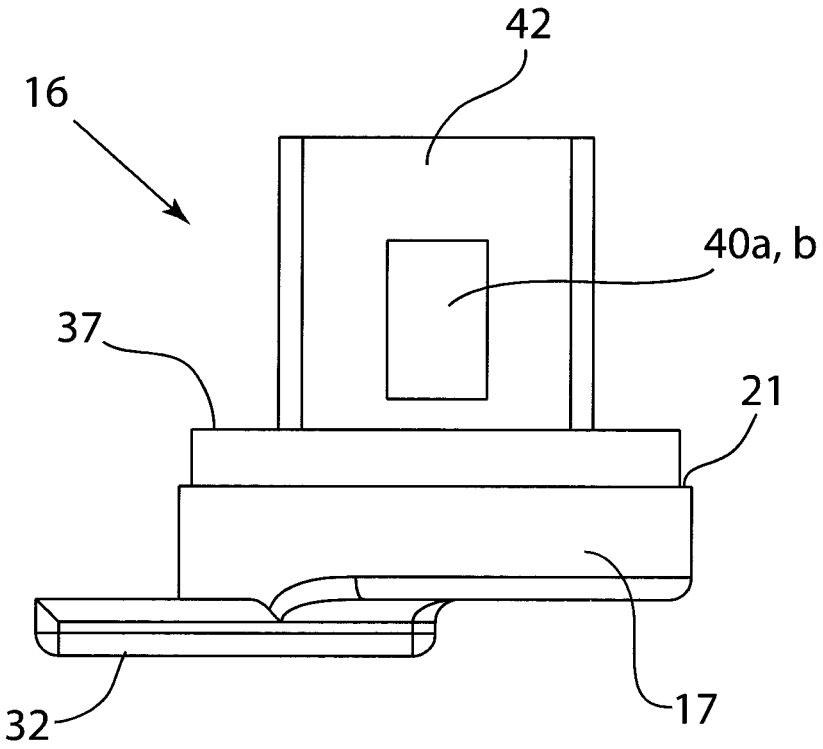
FIG. 16 depicts a right side view of the second side component shown in FIGS. 11-15 in accordance with one embodiment.
Figure 17:
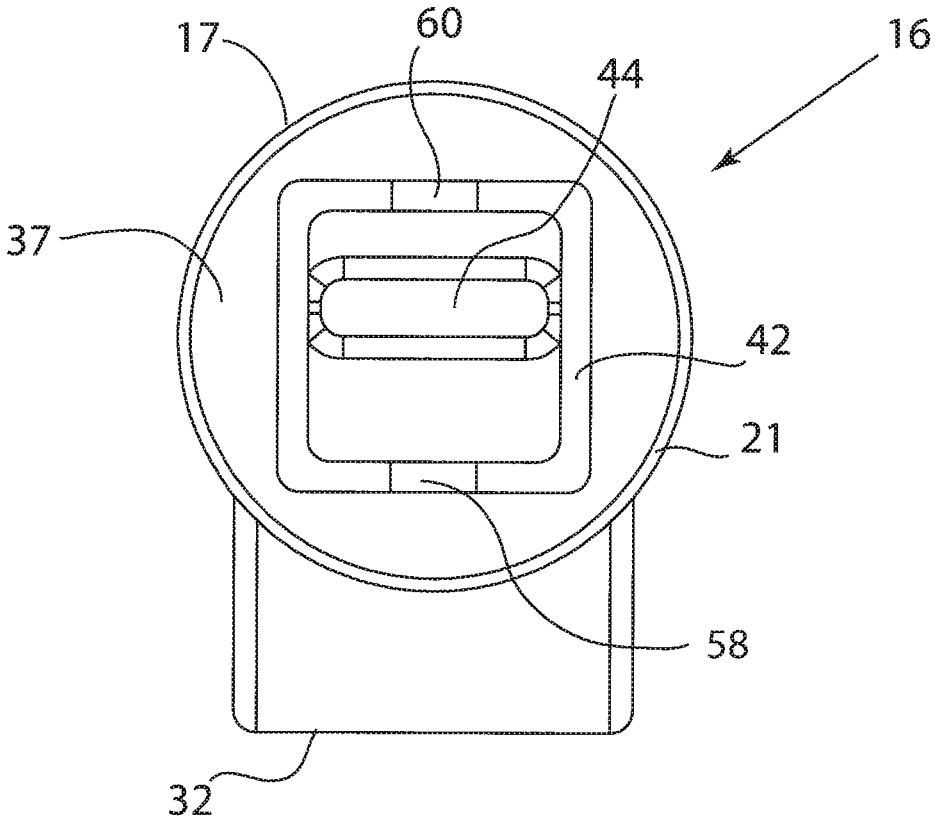
FIG. 17 depicts a bottom view of the second side component shown in FIGS. 11-16 in accordance with one embodiment.

Referring now to FIGS. 4-17, several views of the first and second side components 14, 16 of the temporary door hardware system 10 are shown. The first side component 14 is shown including a male connecting section 34. The male connecting section 34 may extend from a bottom surface 35 of the main body 15 and may include a square shaped cross section, for example, as shown in the perspective views of FIGS. 4 and 5 and the bottom view in FIG. 10. The male connecting section 34 may include at least one locking tab 36*a*, 36*b*. The male connecting section 34 may be insertable into a female connecting section 38 of the second side component 16. The female connecting section 38 may extend from a bottom surface 37 of the main body 17 of the second side component 16. The female connecting section 38 may also include a square shaped cross section, as shown in the perspective views of FIGS. 11 and 12 and the bottom view in FIG. 17. Thus, the male connecting section 34 may be dimensioned slightly smaller than the female connecting section 38 to allow the male connecting section 34 to slide into the female connecting section 38. The female connecting section 38 may include at least one channel 40*a*, 40*b* corresponding with and configured to receive each of the locking tabs 36*a*, 36*b* of the male connecting section 34. Thus, when the male connecting section 34 is inserted into the female connecting section 38, the locking tabs are configured to engage with the channels 40*a*, 40*b* in order to lockably attach the male connecting section 34 to the female connecting section 38. In operation, the locking tabs 36*a*, 36*b* may be configured to temporarily bend inwardly from the contact with a locking tab biasing portion 42 of the female connecting section 38. Then, once the locking tabs 36*a*, 36*b* clear from the locking tab biasing portion 42 and emerge into the channels 40*a*, 40*b* of the female connecting section 38, the locking tabs 36*a*, 36*b* may be configured to unbend outwardly and remain affixed in the channels 40*a*, 40*b*, preventing separation of the first side component 14 and the second side component 16.

Once locked or affixed together, the first and second side components 14, 16 may be configured to remain in a locked-together state. In the embodiment shown, the mechanism for locking the first and second side components 14, 16 together (i.e. at least one of the male connecting section 34, the female connecting section 38, the locking tabs 36*a*, 36*b*, the channels 40*a*, 40*b*, and the locking tab biasing portion 42) may not be unattached without permanent destruction. For example, the permanent destruction of one or more components of the mechanism may be required to remove the first side component 14 from the second side component 16. In the embodiment shown, the second side component 16 may include an opening 44 that is adjacent to the surface 32. The opening 44 may be a channel, hole, slot, bore, or the like. The opening 44 may be configured to receive an elongated device, such as a screwdriver (not shown) which may be configured to destroy one or both of the locking tabs 36*a*, 36*b*. In the embodiment shown, the opening 44 extends across the entirety of the width of the female connecting section 38, allowing the elongated device to be extended therein. By bashing, hitting, protruding, hammering, or striking the plastic locking tabs 36*a*, 36*b* with a metal or otherwise reinforced or durable elongated device, the locking tabs 36*a*, 36*b* may be destroyed, and the temporary door hardware system 10 may be configured to be removed from the door 12 for reinstallation of a permanent door hardware system (not shown). In one embodiment, the locking tabs 36*a*, 36*b* may be particularly constructed such that they are mechanically weak from force coming from the direction of the opening 44. As such, the locking tabs 36*a*, 36*b*, which may be strong in preventing the male and female connecting sections 34, 38 from being taken apart, may be very weak and break easily when prodded with an elongated device through the opening 44. This may facilitate ease of removal of the temporary door hardware system 10.

In another embodiment, the male connecting section 34 may include only a single locking tab rather than two locking tabs. This locking tab may be found on one of the "sides" of the square shaped cross section of the male connecting section 34. Likewise, the female connecting section 38 may include a single corresponding channel. In this embodiment, the opening 44 may be narrower than the embodiment shown in the Figures, such that it would be more difficult for a person who protrudes the elongated device into the opening 44 to miss hitting the locking tab. In another embodiment, the opening 44 in the face of the second side component 16 may actually be divided into two separate openings, each corresponding to and directly in front each of two locking tabs 36*a*, 36*b* extending within the male connecting section 34. If destruction of the attachment mechanism is desirable, it should be understood that the means for destruction of the attachment mechanism are not limited to the embodiments shown or described herein.

While the temporary door hardware system 10 may include a mechanism for attaching the first and second side components 14, 16 together such that unattachment of the first and second side components 14, 16 requires permanent destruction of the mechanism, other embodiments may not include this feature. For example, nondestructive mechanisms for unattaching the first and second side components 14, 16 are contemplated. In one embodiment, the temporary door hardware system 10 may include an opening, such as the opening 44, for inserting an unlocking device. The unlocking device may be configured to integrate with the attachment mechanism. For example, the unlocking device may be directly configured to bend inwardly one or more locking tabs, such as the locking tabs 36*a*, 36*b* in order to release the locking tabs 36*a*, 36*b* from the channel 40*a*, 40*b*.

Figure 18:
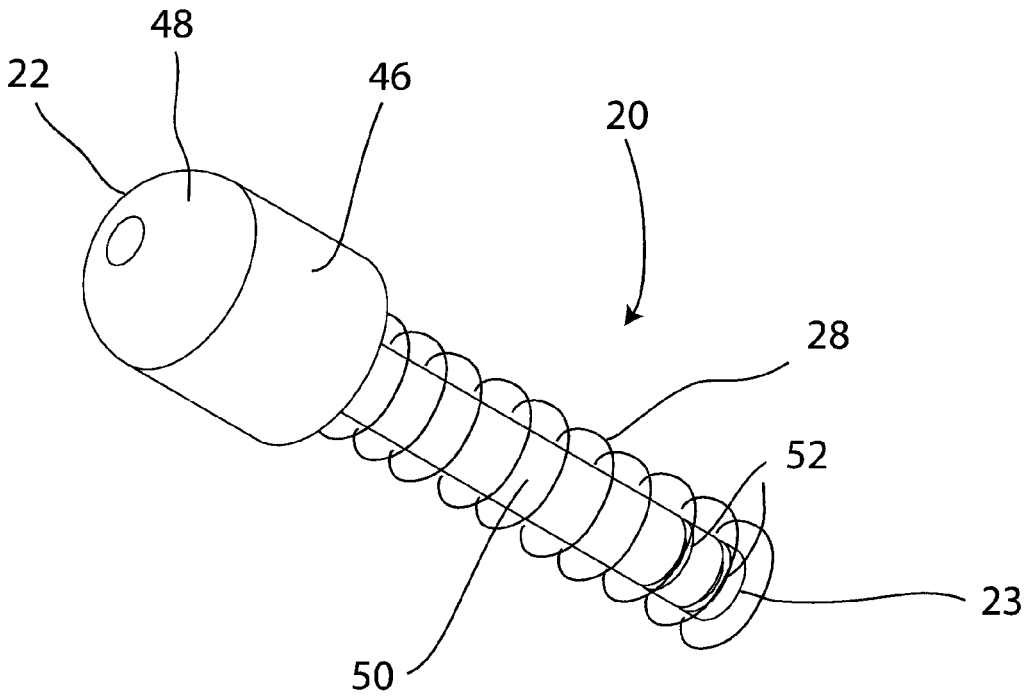
FIG. 18 depicts a perspective view of a latch assembly component of the temporary door hardware system shown in FIGS. 1-3 in accordance with one embodiment.
Figure 19:
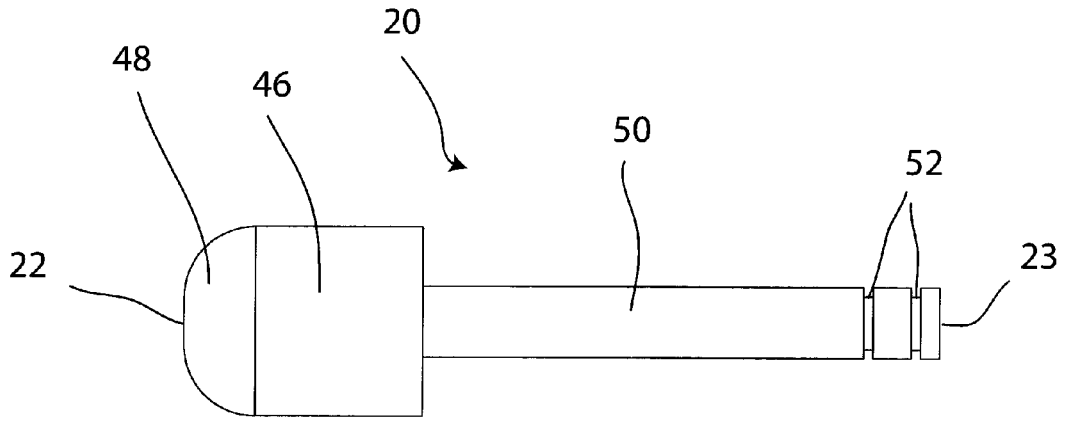
FIG. 19 depicts a side view of the latch assembly component shown in FIG. 18 in accordance with one embodiment.

As described hereinabove, the temporary door handle 10 may include the latch assembly 20. The latch assembly 20 is shown in FIGS. 18 and 19. The latch assembly 20 may operate in conjunction with the opening 24 found in the strike plate 27 or otherwise integrated into the outer frame 26 of the door 12. The latch assembly 34 may extend between the first end 22 and a second end 23. The second end 23 may be located within the male connecting section 34 of the first side component 14 and the female connecting section 38 of the second side component 16. The first end 22 may be located outside of the male connecting section 34 and the female connecting section 38 and may be dimensioned for integration with the opening 24 of the strike plate 27 or door frame 26.

The first end 22 of the latch assembly 20 may be an enlarged knob portion 46 having a half spherical end 48. The half spherical end 48 may be the particular portion of the latch assembly 20 partially insertable into the opening 24. Thus, due to the curvature of the first end 22 of the latch assembly 20, the latch assembly may rest in the opening 24 such that a horizontal force F on the latch assembly 20 will actually result in movement of the latch assembly 20 to retract along the vertical direction D, as shown in FIG. 1.

The latch assembly 20 may include a narrower portion 50 extending from the enlarged knob portion 46 to the second end 23. The enlarged knob portion 46 and the narrower portion 50 may each have a circular cross section. A spring 28 may be configured to extend between the back surface of the enlarged knob portion 46. The spring 28 may extend between the enlarged knob portion 46 and the outer surface of the female connecting section 38. The spring 28 may have a diameter that is less than the diameter of the enlarged knob portion 46 such that the spring 28 is retained therebetween. In one embodiment, the spring 28 found in the latch assembly 20 may be the only metallic component in one embodiment.

Additionally, the second end 23 of the narrow portion 50 may include one or more circumferential channels 52 extending circumferentially around the entirety of the narrow portion 50. These channels 52 may each be configured to receive a C-Clip (not shown). The C-Clip may be configured to retain the second end 23 of the narrow portion 50 within the confines of the male and female connecting sections 34, 38.

Located in the male connecting section 34 may be a first U-shaped opening 54 and a second U-shaped opening 56. Likewise, in the female connecting plate 38 may have a third U-shaped opening 58 which corresponds to the first U-shaped opening 54, and a fourth U-shaped opening 60 which corresponds to the second U-shaped opening 56. These U-shaped opening pairs 54, 58 and 56, 60 may each converge to form a corresponding circular shaped opening when the male connecting section 34 is inserted into the female connecting section 38. These two circular shaped openings may be configured to receive the narrow portion 50 of the latch assembly 20. In one embodiment, only a single U-shaped opening pair 54, 58 or 56, 60 may exist in the male connecting section 34 and the female connecting section 38. This may allow only a single configuration of the latch assembly 20 extending in a single direction. In other embodiments, both opening pairs 54, 58 and 56, 60 may exist to allow the temporary door hardware system 10 to be installed in multiple arrangements with the latch assembly 20 extending from either direction.

The latch assembly 20 may thereby be retained in place within this opening between the spring 28 and the C-Clip, in the manner shown in FIG. 1. Held into place in this manner within the male and female connecting sections 34, 38 of the first and second side components 14, 16, the latch assembly 20 may be configured to extend and retract with respect to the first and second side components 14, 16. The two circumferential channels 52 found at different lengths of the narrow portion 50 may be configured to extend the first end 22 of the latch assembly 20 from the first and second side components 14, 16 at different amounts, depending on which circumferential channel the C-Clip is placed in. In this manner, the latch assembly 20 may configured for doors having different dimensions. For example, some doors require a longer latch assembly 20 than others, and the C-Clip and circumferential channel combination may provide the temporary door hardware system 10 to be customizable for various door systems.

As will be apparent, a door may be sold and manufactured with the temporary door hardware system 10 described herein already installed. These pre-installed doors may be transportable with the same or similar dimensions as doors without hardware installed, due to the narrow features of the temporary door hardware system 10 and the fact that the system may not include protruding components which would increase the transportation and storage dimensions of the system significantly. Thus, in one embodiment, an installer may simply need to install a strike plate or otherwise fashion the opening 24 in the door frame 26, and then install the door 12 having the temporary hardware system 10 pre-installed. The door 12 may be sold with the elongated elements (not shown) that allow for removal of the handle. Alternately, directions may be provided for the user to insert a screwdriver or other elongated element into the opening 44 in order to allow the first and second side components 14, 16 to be pulled apart and the temporary door hardware system 10 to be removed. Then, when an installer needs to install the permanent hardware, the temporary door hardware system 10 may be removed and disposed of, or (if no destruction of parts is required for removal) stored for later use.

Still further, a method of providing a door hardware system is also contemplated. The method may include attaching a temporary door hardware system to a door. This step may be performable in a factory during the manufacturing of the door, or prior to the purchase of the door by the consumer, or after the purchase of the door by a consumer. The method may further include attaching the male connecting section 34 with the female connecting section 38 by locking the locking tabs 36*a*, 36*b* into the channels 40*a*, 40*b*. The method may include securing the latch assembly 20 between the first and second side components 14, 16 and biasing the latch assembly 20, including extending the latch assembly 20 into the opening 24 and retracting the latch assembly 20 from the opening 24. The biasing may be accomplished with the spring 28. The method may include exerting a force on the door 12 which thereby causes the latch assembly to retract from the opening 24. The method may further include preventing the latch assembly 20 from being removed from the opening 24 when wind forces are exerted on the door 12, and allowing the latch assembly 20 to be removed from the opening 24 when a person exerts a direct pushing force on the door 12. This preventing and allowing the latching assembly 20 to be moved may be accomplished by the engineering tolerances and spring constant of the spring 28. Still further, the method may include permanently destroying one or both of the locking tabs 36*a*, 36*b* by inserting a device into the opening 44 found in a front face of the second side component 16 to break one or both of the locking tabs 36*a*, 36*b*. The method may further include replacing the temporary door hardware system 10 with a permanent door hardware system, and disposing of the replaced temporary door hardware system 10.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

We claim:

1. A temporary door hardware system comprising:

a first side component configured to be exposed from a first side of a door when the temporary door hardware system is installed in the door;

a second side component attachable to the first side component and configured to be exposed from a second side of the door when the temporary door hardware system is installed in the door;

a latch assembly securable between the first and second side component when the first and second side component are installed in the door, wherein the latch assembly is dimensioned for integration with an opening in a door frame, wherein the latch assembly includes a spring bias configured to extend the latch assembly into the opening and allow retraction of the latch assembly from the opening when a first threshold force is exerted on the door, wherein the first and second side components include a mechanism for attaching the first and second side components together such that the only way to unattach the first and second side components requires permanent destruction of the mechanism.

2. The temporary door hardware system of claim 1, wherein a second threshold force of the spring bias on the latch assembly is large enough to prevent the latch assembly from being removed from the opening when wind forces are exerted on the door, and small enough to allow the latch assembly to be removed from the opening when a user exerts the first threshold force on the door.

3. The temporary door hardware system of claim 1, wherein the first side component, the second side component, and the latch assembly, are at least substantially formed from a nonmetallic material.

4. The temporary door hardware system of claim 1, wherein the first side component and the second side component do not include a handle or knob.

5. The temporary door hardware system of claim 4, wherein the first side component and the second side component are dimensioned to extend less than 0.5 inches from each of a first and a second respective surface of either side of the door.

6. The temporary door hardware system of claim 1, wherein the mechanism for attaching includes a locking tab located in the first side component configured to interact with a channel located in the second side component, and wherein the locking tab is configured to be permanently destroyed by inserting a device into an opening found in a front face of the second side component to break the locking tab.

7. The temporary door hardware system of claim 6, wherein the locking tab is located in a male connecting section of the first side component, the male connecting section including a substantially square cross section extending from a main body of the male connecting section, and wherein the channel is located in a female connecting section of the second side component, the female connecting section including a substantially square cross section and extending from a main body of the female connecting section, the female connecting section being larger than the male connecting section such that the male connecting section is insertable into the female connecting section in order to lock the first side component together with the second side component.

8. The temporary door hardware system of claim 7, wherein the latch assembly extends between a first end and a second end, and wherein the first end is located outside of the male connecting section and the female connection section and is dimensioned for integration with the opening in the door frame, and wherein the second end is located within the male connecting section and the female connecting section.

9. The temporary door hardware system of claim 1, wherein the threshold force is exerted on the latch assembly, and wherein the threshold force is perpendicular to a direction of extension and retraction of the latch assembly.

10. The temporary door hardware system of claim 1, wherein the mechanism for attaching includes a locking tab located in the first side component, wherein a portion of the first side component is configured to be inserted into a portion of the second side component such that the locking tab bends inwardly, wherein the second side component includes a channel configured to receive the locking tab when the portion of first side component has been inserted into the portion of the second side component such that the locking tab unbends outwardly to prevent separation of the first side component and the second side component.

11. A temporary door hardware system comprising:

a first side component configured to be accessible from a first side of a door when the temporary door hardware system is installed in the door;

a second side component attachable to the first side component and configured to be accessible from a second side of the door when the temporary door hardware system is installed in the door;

wherein the first and second side components include a mechanism for attaching the first and second side components together, wherein the mechanism for attaching includes a locking tab located in the first side component, wherein a portion of first side component is configured to be inserted into a portion of the second side component such that the locking tab bends inwardly, wherein the second side component includes a channel configured to receive the locking tab when the portion of first side component has been inserted into the portion of the second side component such that the locking tab unbends outwardly to prevent separation of the first side component and the second side component, wherein the locking tab is configured to be permanently destroyed to separate the first side component from the second side component by inserting a device into an opening found in a front face of the second side component to break the locking tab.

12. The temporary door hardware system of claim 11, further comprising a latch assembly securable between the first and second side components when the first and second side component are installed in the door, wherein the latch assembly is dimensioned for integration with an opening in a door frame, wherein the latch assembly includes a spring bias configured to extend the latch assembly into the opening and allow retraction of the latch assembly from the opening when a first threshold force is exerted on the door.

13. The temporary door hardware system of claim 12, wherein a second threshold force of the spring bias on the latch is large enough to prevent the latch assembly from being removed from the opening when wind forces are exerted on the door, and small enough to allow the latch assembly to be removed from the opening when a user exerts the first threshold force on the door.

14. The temporary door hardware system of claim 12, wherein the first side component, the second side component, and the latch assembly, are at least substantially formed from a nonmetallic material.

15. The temporary door hardware system of claim 12, wherein the first threshold force is exerted on the latch assembly, and wherein the first threshold force is perpendicular to a direction of extension and retraction of the latch assembly relative to the door.

16. The temporary door hardware system of claim 11, wherein the first side component and the second side component do not include a handle or knob, and wherein the first side component and the second side component are dimensioned to extend less than 0.5 inches from each of a first and a second respective surface of either side of the door.

17. The temporary door hardware system of claim 11, wherein the portion of the first side component is a male connecting section having the locking tab located therein, the male connecting section including a substantially square cross section extending from a main body of the male connecting section, and wherein the portion of the second side component is a female connecting section having the channel located therein, the female connecting section including a substantially square cross section extending from a main body of the female connecting section, the female connecting section being larger than the male connecting section such that the male connecting section is insertable into the female connecting section in order to lock the first side component together with the second side component, and thereby prevent separation of the first side component and the second side component.

18. The temporary door hardware system of claim 17, wherein the latch assembly extends between a first end and a second end, and wherein the first end is located outside of the male connecting section and the female connection section and is dimensioned for integration with the opening in the door frame, and wherein the second end is located within the male connecting section and the female connecting section.

19. A door comprising:

a first side having a first surface;

a second side having a second surface;

a door hardware system comprising:

a first side component exposed from the first side of the door;

a second side component attached to the first side component and exposed from the second side of the door;

a latch assembly securable between the first and second side component, wherein the latch assembly is dimensioned for integration with an opening in a door frame, wherein the latch assembly includes a spring bias configured to extend the latch assembly into the opening and allow retraction of the latch assembly from the opening when a threshold force is exerted on the door, wherein the first and second side components include a mechanism for attaching the first and second side components together such that the only way to unattach the first and second side components requires permanent destruction of the mechanism.

20. A temporary door hardware system comprising:

a first side component configured to be accessible from a first side of a door when the temporary door hardware system is installed in the door;

a second side component attachable to the first side component and configured to be accessible from a second side of the door when the temporary door hardware system is installed in the door;

wherein the first and second side components include a mechanism for attaching the first and second side components together, wherein the mechanism for attaching includes a locking tab located in the first side component, wherein a portion of first side component is configured to be inserted into a portion of the second side component such that the locking tab bends inwardly, wherein the second side component includes a channel configured to receive the locking tab when the portion of first side component has been inserted into the portion of the second side component such that the locking tab unbends outwardly to prevent separation of the first side component and the second side component, wherein the first side component and the second side component do not include a handle or knob, and wherein the first side component and the second side component are dimensioned to extend less than 0.5 inches from each of a first and a second respective surface of either side of the door.

21. A temporary door hardware system comprising:

a first side component configured to be accessible from a first side of a door when the temporary door hardware system is installed in the door;

a second side component attachable to the first side component and configured to be accessible from a second side of the door when the temporary door hardware system is installed in the door;

wherein the first and second side components include a mechanism for attaching the first and second side components together, wherein the mechanism for attaching includes a locking tab located in the first side component, wherein a portion of first side component is configured to be inserted into a portion of the second side component such that the locking tab bends inwardly, wherein the second side component includes a channel configured to receive the locking tab when the portion of first side component has been inserted into the portion of the second side component such that the locking tab unbends outwardly to prevent separation of the first side component and the second side component;

a latch assembly securable between the first and second side components when the first and second side component are installed in the door, wherein the latch assembly is dimensioned for integration with an opening in a door frame, wherein the latch assembly includes a spring bias configured to extend the latch assembly into the opening and allow retraction of the latch assembly from the opening when a first threshold force is exerted on the door, wherein the first threshold force is exerted on the latch assembly, and wherein the first threshold force is perpendicular to a direction of extension and retraction of the latch assembly relative to the door.

* * * * *